US010696455B2

(12) United States Patent
Miller et al.

(10) Patent No.: US 10,696,455 B2
(45) Date of Patent: Jun. 30, 2020

(54) CLOSURE/STOPPER WITH MULTI-LAYER FILM AFFIXED THERETO

(75) Inventors: Darrell James Miller, Holly Springs, NC (US); Lindsay Herman Davis, Raleigh, NC (US); Marco Josef Otto Kirch, Cary, NC (US); Daniel Robert Bartholomew, Knightdale, NC (US); Olav Marcus Aagaard, Rotterdam (NL); Malcolm Joseph Thompson, Cary, NC (US)

(73) Assignee: VINVENTIONS USA, LLC, Zebulon, NC (US)

( * ) Notice: Subject to any disclaimer, the term of this patent is extended or adjusted under 35 U.S.C. 154(b) by 1148 days.

(21) Appl. No.: 12/733,576

(22) PCT Filed: Sep. 11, 2008

(86) PCT No.: PCT/US2008/010701
§ 371 (c)(1),
(2), (4) Date: Mar. 8, 2011

(87) PCT Pub. No.: WO2009/035685
PCT Pub. Date: Mar. 19, 2009

(65) Prior Publication Data

US 2011/0147336 A1 Jun. 23, 2011

Related U.S. Application Data

(60) Provisional application No. 60/993,492, filed on Sep. 11, 2007.

(51) Int. Cl.
*B65D 39/00* (2006.01)

(52) U.S. Cl.
CPC ..... *B65D 39/0076* (2013.01); *B65D 39/0058* (2013.01); *B65D 2539/008* (2013.01)

(58) Field of Classification Search
CPC ..... B65D 39/00; B29D 22/00; B32B 1/00; B32B 3/02; B32B 3/26; B32B 27/00
(Continued)

(56) References Cited

U.S. PATENT DOCUMENTS 5,527,580 A * 6/1996 Ikeda et al. ..... 428/68
5,904,965 A * 5/1999 Noel et al. ..... 428/36.5
(Continued)

FOREIGN PATENT DOCUMENTS

EP 1487710 A2 12/2004
FR 2852926 A1 10/2004

OTHER PUBLICATIONS

Extended European Search Report for European Application No. 08830264.1 dated Feb. 22, 2011.

*Primary Examiner* — Ernesto A Grano
(74) *Attorney, Agent, or Firm* — Withrow & Terranova, P.L.L.C.; Vincent K. Gustafson

(57) ABSTRACT

By securely affixing or bonding a multi-layer film to the terminating end of a closure/stopper, with the multi-layer film being constructed for promoting the transfer of all of the desirable gases, chemicals, and/or compounds while preventing the transfer of undesirable gases, chemicals, and/or compounds, a unique, closure or stopper having a sealed and/or barrier bearing terminating end is achieved. In this way, wine sealed in the wine bottle by the closure/stopper of the present invention is assured of possessing a long storage life, while also having the flavor, bouquet, taste, and quality desired for the wine fully maintained.

21 Claims, 3 Drawing Sheets

(58) Field of Classification Search
USPC ..... 215/355, 358, 364; 428/339, 423.1, 522, 428/64.1, 141
See application file for complete search history.

(56) References Cited

U.S. PATENT DOCUMENTS

| | | | | |
|---|---|---|---|---|
| 6,601,722 | B1 * | 8/2003 | Litoux-Desrue et al. | 215/364 |
| 6,796,449 | B2 * | 9/2004 | Fragola | B65D 39/00 215/364 |
| 2003/0161985 | A1 * | 8/2003 | Lauer | 428/64.1 |
| 2006/0035074 | A1 * | 2/2006 | Taylor | 428/339 |

* cited by examiner

CLOSURE/STOPPER WITH MULTI-LAYER FILM AFFIXED THERETO

STATEMENT OF RELATED APPLICATION(S)

This application is a 35 U.S.C. § 371 national phase filing of International Application No. PCT/US2008/010701 filed on Sep. 11, 2008, and claims the benefit of U.S. Provisional Patent Application No. 60/993,492 filed on Sep. 11, 2007, wherein the disclosures of the foregoing applications are hereby incorporated by reference herein in their respective entireties.

TECHNICAL FIELD

This invention relates to closures or stoppers for containers and, more particularly, to closures or stoppers which are removable from the container and are constructed to enhance the product stored in the container.

BACKGROUND ART

A wide variety of different products are commonly sold in containers, particularly containers with round necks which define the dispensing portal. In this regard, numerous constructions have been created for closing the dispensing portal. In particular, products such as vinegar, vegetable oils, laboratory liquids, detergents, honey, condiments, spices, alcoholic beverages, and the like, impose similar requirements on the type and construction of the closure means being used for the containers within which these products are retained.

One product which imposes the most demanding requirements on a bottle closure is wine, due to the unique sealing requirements needed for preserving and maintaining the flavor of the wine while stored in the bottle. Presently, wine bottle closures or stoppers are constructed from a range of material formed from cork, synthetic plastic materials, fillers, bonding agents and combinations thereof.

Although cork, which is a natural product, has been widely used as the source for most wine bottle closures, cork material is a limited resource which is becoming increasingly difficult to harvest in sufficient quantities to meet the ever growing demands. Furthermore, irregularities in the cork's structure due to geographic, climate, and ecological reasons, cause many quality grades to exist in the harvested product. This creates a complex categorization of qualities and standards. In addition, it is estimated that 1% to 5% of all bottled wine is spoiled by cork taint.

Another problem commonly found with natural cork is leaking bottles. Typically, the lack of tightness between the cork and the neck of the bottle causes 10% to 20% of bottle leakage. However, the majority of wine leakage is caused by passage of the wine through the cork's body. These problems are most often found with lower quality cork material, which is typically porous, too soft, out of round, or out of the established specifications.

In order to avoid some of the difficulties encountered with the use of cork closures, bottlers have developed various coatings, such as paraffins, silicones, and polymer materials, in an attempt to ease the movement of the cork into and out of the bottle, as well as to improve the permeability of the cork and fill imperfections in the cork surface. However, no ideal cork coating product has been developed to protect a wine corking member from all of the inherent difficulties or drawbacks of the material.

The majority of wine containing bottles are currently being sold with natural cork stoppers. However, due to the inherent problems existing with natural cork, other products have been developed to seal liquid bearing containers, such as wine bottles. The principal alternate material presently being employed for sealing wine bottles comprises synthetic plastic material, typically a thermoplastic material. In addition, due to the increasing difficulties and quality control problems inherent with cork material, wine bottlers are employing closures formed of synthetic plastic material in ever increasing quantities.

Regardless of the material employed for forming closures or stoppers for wine bottles, one of the principal difficulties to which any bottle closure is subjected is the manner in which the closure is inserted into the wine bottle. Typically, the closure is placed in a jaw clamping member positioned above the bottle portal. The clamping member incorporates a plurality of separate and independent jaw members which peripherally surround the closure member and are movable relative to each other to compress the closure member to a diameter substantially less than its original diameter. Once the closure member has been fully compressed, a plunger moves the closure means from the jaws directly into the neck of the bottle, wherein the closure member expands into engagement with the interior diameter of the bottle neck and portal, thereby sealing the bottle and the contents thereof.

During the process of inserting the closure into the portal of the wine bottle, it has been found that a friction reducing coating usually must be applied to the outer surface of the closure or stopper in order to enable the stopper to be fully inserted into the neck of the bottle. Typically, if a friction reducing coating is not applied to the surface of the closure or stopper, the stopper expands immediately upon exiting the jaws and frictionally engages the surface of the bottle neck prior to being completely inserted into the wine bottle.

In most applications, the friction reducing coating comprises one selected from the group consisting of paraffins, silicones, and other similar compositions which provide the desired friction reduction to the surface of the closure, while also being capable of being easily applied and retained on the outer surface of the closure. In addition, regardless of the composition of the wine bottle closure or stopper, the use of a friction reducing material is generally required.

It has also been found that the compression of the closure during the insertion process causes oxygen which has been trapped inside the cells of the closure to be released into the head space of the wine. As a result, free sodium dioxide in the head space is significantly reduced, causing a substantial negative effect on the storage shelf life of the wine.

Due to the unique characteristics of wine and the wide variety of environmental and chemical interactions which affect the taste, fragrance, and bouquet of wine products, the construction of closures employed in the wine industry have received significant attention. In this regard, in addition to forming synthetic closures for wine bottles with numerous chemical additives retained therein or applied to the outer surface of the closure, substantial attention has also been directed to sealing the ends of the closure with a separate material or coating in order to control the transfer of desirable chemicals, compounds, and/or gases through the closure for enhancing the wine product as well as preventing the transfer of undesirable chemicals, compounds, and/or gases through the closure for reducing or eliminating wine degradation.

In this regard, many prior art synthetic closures have been constructed with various end caps or sealing material affixed to the terminating end of the closure for being positioned inside the wine bottle. However, although substantial attention has been paid to the construction of viable end caps or sealing members, no prior art product has been capable of achieving a construction which is capable of eliminating all of the difficulties encountered in the wine industry.

Therefore, it is a principal object of the present invention to provide a closure or stopper for liquid bearing containers, particularly wine bottles, which completely seals the product within the container while also enhancing the quality, taste, bouquet, and flavor of the wine.

Another object of the present invention is to provide a synthetic closure/stopper having the characteristic features described above which prevents leakage of the product from the container, while also preventing unwanted exchange of undesirable chemicals, compounds, and/or gases through the terminating end of the closure.

Another object of the present invention is to provide a synthetic closure/stopper having the characteristic features described above which promotes and enhances the transfer or exchange of desirable chemicals, compounds, and/or gases through the terminating end of the closure.

Another object of the present invention is to provide a synthetic closure/stopper having the characteristic features described above and comprises a terminating end positioned within the bottle which incorporates a multi-layer film bonded thereto for enhancing the construction of the closure/stopper and improving the quality of the wine product contained therein.

Another object of the present invention is to provide a synthetic closure/stopper having the characteristic features described above which can be mass produced on a continuous basis and eliminates any spoilage of wine due to cork taint.

Other and more specific objects will in part be obvious and will in part appear hereinafter.

SUMMARY OF THE INVENTION

By employing the present invention, all of the difficulties and drawbacks found in the prior art have been overcome and a unique, closure or stopper having a sealed and/or barrier bearing terminating end is achieved. In accordance with the present invention, a multi-layered film is securely affixed or bonded to the terminating end of a closure/stopper with the multi-layered film being constructed for promoting the transfer of all of the desirable gases, chemicals, and/or compounds while preventing the transfer of undesirable gases, chemicals, and/or compounds. In this way, the wine sealed in the wine bottle by the closure/stopper of the present invention is assured of possessing a long storage life, while also having the flavor, bouquet, taste, and quality desired for the wine fully maintained.

THE DRAWINGS

For a fuller understanding of the nature and objects of the invention, reference should be had for the following detailed description, taken in connection with the accompanying drawings, in which.

DETAILED DISCLOSURE

Figure 1:
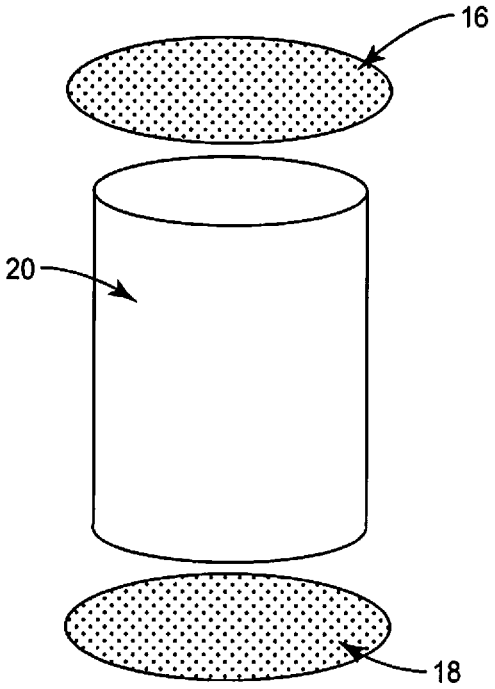
FIG. 1 is a perspective view of a synthetic closure/stopper of the present invention depicting two multi-layer films in position for being affixed to the two opposed terminating ends of the closure/stopper.

By referring to FIGS. 1-6, along with the following detailed disclosure, the construction of the multi-layer film of the present invention, along with its method of affixation to the closure/stopper, can best be understood. In addition, in the following detailed disclosure, the preferred construction of the closure/stopper employed in the present invention is fully detailed and is preferably constructed from synthetic material. However, any desired material may be employed, including natural cork. In this regard, the preferred synthetic closure/stopper comprises a multi-component or multi-layer synthetic closure which is fully detailed herein. However, it is to be understood that the following detailed disclosure of the multi-layer film as well as the multi-component or multi-layer synthetic closure are provided for exemplary purposes only and are not intended as a limitation of the present invention to the particular applications or embodiments detailed herein. In particular, all embodiments that are described herein for a "synthetic closure/stopper" shall equally be disclosed for a "closure/stopper" in general as claimed in Claim 1 below. Furthermore, it should be understood that all references to a synthetic closure/stopper is directed to the preferred embodiment, but all such references should be interpreted to include natural cork or any other non-synthetic material wherever such interpretation may be made.

In a preferred construction of the synthetic closure/stopper 20 of the present invention, multi-layer films 16 are constructed and are formed into a circular shapes having a diameter which is slightly greater than the diameter of the synthetic closure/stopper itself. In this way, multi-layer films 16 are easily bonded to the terminating end of the closure/stopper and wrapped about a small portion of side wall 24 thereof. As a result, multi-layer films 16 are affixed throughout the entire substantially flat terminating ends 22 and 28 of closure/stopper 20, while also peripherally surrounding and enclosing a portion of outer surface 24 thereof.

By employing this construction, assurance is provided that the entire terminating end of the stopper/closure is covered with the multi-layer film, regardless of any variations that may occur in the shape of the terminating end due to diameter variations, roundness, ovality, and squareness of cut. Furthermore, the multi-layer film application construction of the present invention also has been found to reduce or eliminate lipping during insertion of the closure into the bottleneck, while also improving reinsertion of the stopper/closure.

Figure 2:
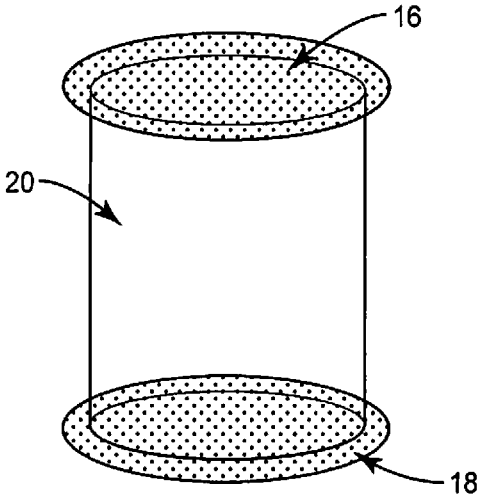
FIG. 2 is a perspective view of the synthetic closure/stopper of FIG. 1 depicting the two multi-layer films bonded to the two opposed terminating ends of the closure/stopper.
Figure 3:
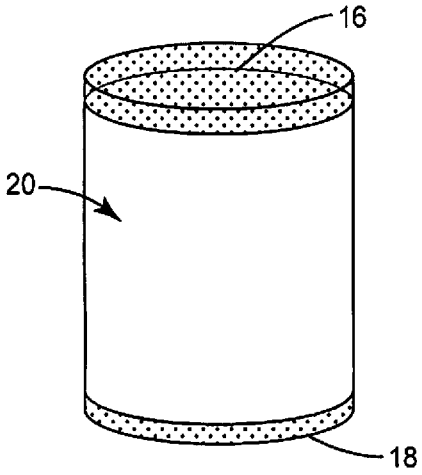
FIG. 3 is a perspective view of the synthetic closure/stopper of FIG. 2 depicting the two multi-layer films fully bonded to the two opposed terminating ends of the closure/stopper with the outer edges of the multi-layer films bonded to the side surfaces of the closure/stopper.
Figure 4:
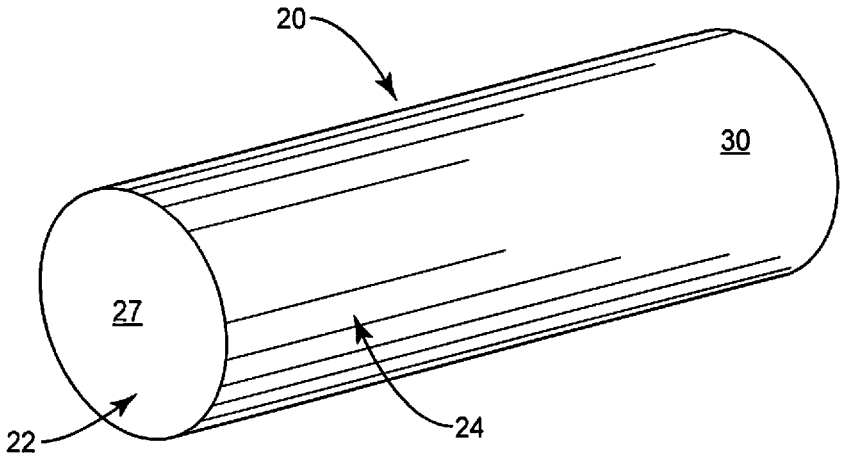
FIG. 4 is a perspective view of the preferred construction employed for the closure/stopper of the present invention.
Figure 5:
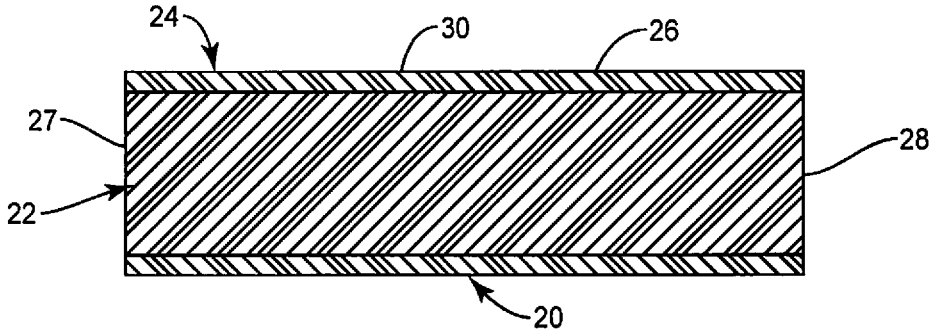
FIG. 5 is a cross-sectional side elevation view of the synthetic closure/stopper of FIG. 4 depicting the preferred multi-component or multi-layer construction employed therefor.
Figure 6:
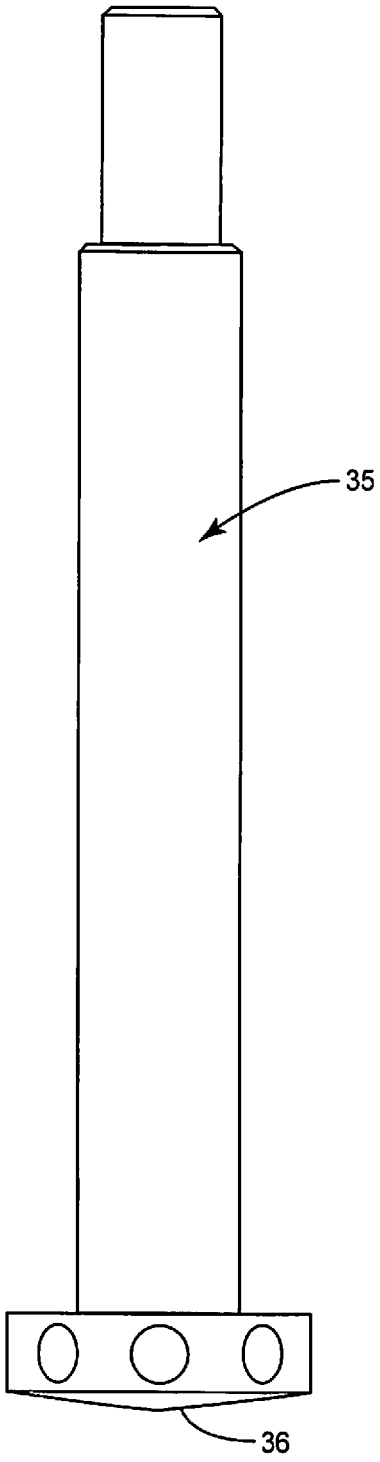
FIG. 6 is a side elevation view of an application tool employed for affixing the multi-layer film to the terminating end of the closure/stopper.

As shown in FIGS. 1-3, in accordance with the present invention, multi-layer films 16 and 18 are affixed to one or both terminating ends of the stopper/closure and are constructed with an overall diameter which preferably ranges between about 0.50 mm and 5.0 mm greater than the diameter of the closure/stopper. It has also been found that this enlarged diameter range is more preferably between about 1.5 mm and 2 mm.

In accordance with the present invention, the synthetic closure/stopper may comprise any desired construction. However, as depicted in FIGS. 1 and 2, multi-component/multi-layer synthetic bottle closure 20 preferably comprises core member 22 and peripheral layer 24 which peripherally surrounds and is integrally bonded to core 22. In the preferred embodiment, core member 22 comprises a substantially cylindrically shaped surface 26 terminating with substantially flat end surfaces 27 and 28.

In the preferred embodiment, surrounding layer 24 is intimately bonded directly to core member 22, peripherally surrounding and enveloping surface 26 of core member 22. Peripheral layer 24 incorporates exposed surface 30, which comprises a substantially cylindrical shape and forms the outer surface of multi-component/multi-layer synthetic bottle closure 20 of the present invention, along with flat end surfaces 27 and 28.

In order to produce the attributes required for use in the wine industry, core 22 is formed from foam plastic material using a continuous extrusion process. Although other prior art systems have employed molded foamed plastic material, these processes have proven to be more costly and incapable of providing a final product with the attributes of the present invention.

In the preferred embodiment, core member 22 is formed as an extruded, medium or low density closed cell foamed plastic comprising one or more plastics selected from the group consisting of inert polymers, homopolymers, and copolymers. The preferred plastic material is preferably selected from the group consisting of polyethylenes, metallocene catalyst polyethylenes, poly-butanes, polybutylenes, polyurethanes, silicones, vinyl based resins, thermoplastic elastomer, polyesters, ethylene acrylic copolymers, ethylene-vinyl-acetate copolymers, ethylene-methyl acrylate copolymers, ethylene-butyl-acrylate copolymers, ethylene-propylene-rubber, styrene butadiene rubber, ethylene-ethyl-acrylic copolymers, ionomers, polypropylenes, and copolymers of polypropylene and copolymerizable ethylenically unsaturated commoners. Furthermore, if a polyethylene is employed, it has been found that the polyethylene may comprise one or more polyethylenes selected from the group consisting of high density, medium density, low density, linear low density, ultra high density, and medium low density.

Regardless of the foamable plastic material selected for forming core member 22, the resulting extruded foam product can have a density ranging between about 100 kg/m$^3$ to 500 kg/m$^3$. Although this density range has been found to provide an effective core member, the density of the extruded foam core member 20 preferably ranges between about 200 kg/m$^3$ to 350 kg/m'.

Since core member 22 is substantially closed cell in structure, additives are intermixed with the plastic material to form a closed cell foam with minute cells. The resulting core member 22 of the present invention preferably has average cell sizes ranging from between about 0.02 millimeters to 0.50 millimeters and/or a cell density ranging between about 25,000,000 cells/cm$^3$ to 8,000 cells/cm$^3$. Although this cell configuration has been found to produce a highly effective product, it has been found that the most desirable product possesses an average cell size ranging between about 0.05 and 0.1 millimeters and/or a cell density ranging between about 8,000,000 cells/cm$^3$ to 1,000,000 cells/cm$^3$. Furthermore, in order to assure that core member 22 possesses inherent consistency, stability, functionality and capability of providing long-term performance, the cell size of core member 22 is homogeneous throughout its entire length and diameter.

In order to control the cell size of core member 22 and attain the desired cell size detailed above, a nucleating agent can be employed. In the preferred embodiment, it has been found that by employing a nucleating agent selected from the group consisting of calcium silicate, talc, clay, titanium oxide, silica, barium sulfate, diamatious earth, and mixtures of citric acid and sodium bicarbonate, the desired cell density and cell size is achieved.

In this regard, it has been found that cell size and cell density is most advantageously realized in the formation of core member 22 by employing between about 0.1 and 5 parts by weight of the nucleating agent for every 100 parts by weight of the plastic foam. In this way, the desired physical characteristics of core member 22 are realized along with the desired control of the cell size and cell density. This leads to product consistency currently not available with natural and synthetic materials.

As is well known in the industry, a blowing agent can be employed in forming extruded foam plastic material. In the present invention, a variety of blowing agents can be employed during the extruded foaming process whereby core member 22 is produced. Typically, either physical blowing agents or chemical blowing agents are employed. Suitable blowing agents that have been found to be efficacious in producing the core member of the present invention comprise one or more selected from the group consisting of: Aliphatic Hydrocarbons having 1-9 carbon atoms, Halogenated Aliphatic Hydrocarbons having 1-9 carbon atoms and Aliphatic alcohols having 1-3 carbon atoms. Aliphatic Hydrocarbons include Methane, Ethane, Propane, n-Butane, Isobutane, n-Pentane, Isopentane, Neopentane, and the like. Among Halogenated Hydrocarbons and Fluorinated Hydrocarbons they include Methylfluoride, Perfluoro-methane, ethyl Fluoride, 1,1-Difluoroethane (HFC-152a), 1,1,1-Trifluoroethane (HFC 430a), 1,1,1,2-Tetrafluoroethane (HFC 134a), Penta-fluoroethane, Perfluoro-ethane, 2,2-Difluoropropane, 1,1,1-Trifluoropropane, Perfluoropropane, Perfluorobutane, Perfluorocyclobutane. Partially Hydrogenated Chlorocarbon and Chlorofluorocarbons for use in this invention include Methyl Chloride, Methylene Chloride, Ethyl Chloride, 1,1,1-Trichlorethane, 1,1-Dichlorol-Fluoroethane (HCFC-141b), 1-Chloro1, 1-Difluoroethane (HCFC142b), 1,1-Dichloro-2,2,2-Trifluoroethane (HCFC-123) and 1-Chloro-1,2,2,2-Tetrafluoroethane-(HCFC124). Fully Halogenated Chlorofluoro-carbons include Trichloromonofluoromenthane (CFC11), Dichlorodifluoromenthane (CFC12), Trichlorotrifluoroethane (CFC113), Dichlorotetrafluoroethane (CFC114), Chloroheptafluoropropane, and Dichlorohexafluoropropane. Fully Halogenated Chlorofluorocarbons are not preferred due to their ozone depiction potential. Aliphatic alcohols include Methanol, Ethanol, n-Propanol and Isopropanol. Suitable inorganic blowing agent useful in making the foam of the present invention include carbon dioxide, nitrogen, carbon, water, air, nitrogen, helium, and argon.

Chemical blowing agents include Azodicarbonamic Azodiisobutyro-Nitride, Benzenesulfonhydrazide, 4,4-Oxybenzene Sulfonylsemicarbazide, p-Toluene Sulfonylsemi-carbazide, Barium Azodicarboxlyate, N,N'-Dimethyl-N,N'-Dinitrosoterephthalamide and Trihydrazinotriazine.

Preferably, in order to produce the desired product, the blowing agent is incorporated into the plastic melt in a quantity ranging between about 0.005% to 10% by weight of the weight of the plastic material.

As detailed above, either a physical blowing agent or a chemical blowing agent can be employed as part of the extrusion process for forming core member 22 of the present invention. However, it has been found that the selection of a physical blowing agent is preferred since physical blowing agents allow core member 22 of synthetic bottle closure 20 to be achieved with a lower density, which is closer to natural cork.

In this regard, a blowing agent which is inert is preferred. Although any desired inert blowing agent may be employed, the blowing agent is preferably selected from the group consisting of nitrogen, carbon dioxides, water, air, nitrogen, helium, and argon. In addition, hydrocarbons can be employed as the blowing agent which are preferably selected from the group consisting of butane, isobutene, pentane, isopentane and propane.

In addition to attaining core member 22 which possesses a construction with physical characteristics similar to nature cork, multi-component or multi-layer synthetic bottle closure 20 of the present invention also comprises peripheral layer 24. Peripheral layer 24 is of particular importance in attaining synthetic bottle closure 20 which is capable of meeting and exceeding all of the difficult requirements imposed upon a closure or stopper for the wine industry.

In the preferred embodiment, peripheral layer 24 is formed from plastic material identical or similar to the plastic material employed for core member 22. However, as detailed below, the physical characteristics imparted to peripheral layer 24 differ substantially from the physical characteristics of core member 22.

In the preferred construction, peripheral layer 24 comprises a thickness ranging between about 0.05 and 5 millimeters and, more preferably, between about 0.1 and 2 millimeters. Although these ranges have been found to be efficacious to producing synthetic bottle closure 20 which is completely functional and achieves all of the desired goals, the preferred embodiment for wine bottles comprises a thickness of between about 0.1 and 1 millimeter.

In producing peripheral layer 24 and achieving the desired tough, score and mar-resistant surface for core member 22, peripheral layer 24 preferably comprises a density ranging between about 300 $kg/m^3$ to 1,500 $kg/m^3$. Most ideally, it has been found that the density of peripheral layer 24 ranges between about 750 $kg/m^3$ to 1,000 $kg/m^3$.

In accordance with the present invention, multi-component or multi-layer synthetic bottle closure 20 of the present invention must be formed with peripheral layer 24 intimately bonded to substantially the entire surface 26 of core member 22. If any large unbonded areas exist, flow paths for gas and liquid could result. Consequently, secure, intimate, bonded interengagement of peripheral layer 24 with core member 22 is required for attaining a bottle closure for the wine industry.

In order to achieve this integral bonded interconnection between peripheral layer 24 and core member 22, peripheral layer 24 is formed about core member 22 in a manner which assures intimate bonded engagement. Preferably, the desired secure, intimate, bonded, interengagement is attained by simultaneous co-extrusion of core member 22 and peripheral layer 24 or by applying peripheral layer 24 to core member 22 after core member 22 has been formed. By employing either process, intimate bonded interengagement of peripheral layer 24 to core member 22 is attained.

By using equipment well known in this industry, multi-component/multi-layer synthetic bottle closure 20 of the present invention can be produced by co-extruding core member 22 simultaneously with peripheral layer 24 to provide a final product wherein peripheral layer 24 is intimately bonded to core member 22 in a single, continuous operation. If co-extrusion process is employed, once the continuous elongated co-extruded layers forming synthetic bottle closure 20 have been completely formed and are ready for final processing, the elongated dual component material produced is cut to the precise length desired for forming synthetic bottle closures 20.

As detailed above, a wide variety of plastic materials can be employed to produce the extruded multi-component, multi-layer synthetic bottle closure 20 of the present invention. Although each of the plastic materials detailed herein can be employed for both core member 22 and peripheral layer 24, the preferred plastic material for forming both core member 22 and peripheral layer 24 comprises one or more selected from the group consisting of medium density polyethylenes, low density polyethylenes, metallocene catalyst polyethylenes, polypropylenes, polyesters, ethylene-butyl-acrylate copolymers, vinyl-acetate copolymers, ethylene-methyl acrylate copolymers, and blends of these compounds.

It has also been discovered that the outer peripheral layer or skin layer 24 may comprise a thermoplastic composition which differs from the thermoplastic composition employed for the core member. In this regard, the outer peripheral layer 24 may comprise one or more selected from the group consisting of foamable or non-foamable thermoplastic polyurethanes, thermoplastic olefins, thermoplastic vulcanizates, flexible polyolefins, fluoroelastomers, fluoro-polymers, polyethylenes, teflons, and blends thereof. In addition, peripheral layer 24 may be formed from thermoplastic olefinic elastomers such as petrothene TPOE, thermoplastic urethanes thermoplastic polyesters, and other similar product formulas.

The particular composition employed for peripheral layer 24 is selected to withstand the compression forces imposed thereon by the jaws of the corking machine. However, many different polymers, as detailed above, are able to withstand these forces and, as a result, can be employed for peripheral layer 24. In this regard, one principal feature of the present invention is the type of material used for layer 24, as well as the discovery that a substantially solid, non-foamed or foamed plastic-based outer peripheral layer or skin is securely affixed about a foamed plastic center core, to produce a multi-layer synthetic closure which is able to withstand the forces of a cork machine. The ability of the present invention to withstand these forces, without product leakage, exists even if cork dust filler is present between the core and the peripheral layer.

In order to form synthetic bottle closure 20 with all of the desirable inherent physical and chemical properties detailed above, one compound that has been found to be most advantageous to employ for outer peripheral layer 24 is metallocene catalyst polyethylene. As detailed below, outer peripheral layer 24 may comprise 100% metallocene catalyst polyethylene or, if desired, the metallocene catalyst polyethylene may be intermixed with a polyethylene. In this regard, it has been found that outer peripheral layer 24 preferably comprises between about 25% and 100% by weight based upon the weight of the entire composition of one or more polyethylenes selected from the group consisting of medium density polyethylenes, medium low density polyethylenes, and low density polyethylenes.

In the present invention, multi-layer films 16 and 18 are affixed to the terminating ends of the closure/stopper 20 and are capable of being easily bonded to the terminating ends of the closure/stopper with virtually insignificant creasing or wrinkling occurring as a part of the bonding process. In addition, it has been found that the multi-layer films 16 and 18 are preferably bonded to the terminating ends of the closure/stoppers in a two step process. In this two-step process, the multi-layer film is first heat bonded to the substantially flat terminating end of the stopper/closure preferably by employing a heated stamping tool formed from metal and, subsequently, wrapped and heat bonded about the outer peripheral surface of the stopper/closure.

This two-stage heat bonding process is of particular significance in securely affixing the multi-layer film to a synthetic closure/stopper which incorporates two separate and distinct materials, one of which forms the central core of the closure/stopper with the second, skin forming material peripherally surrounding and being securely bounded to the outer surface of the core. In this way, the extremely popular and highly effective, dual material synthetic closure/stopper formed with at least two separate and distinct materials is capable of being manufactured with a multi-layer film barrier securely affixed to the terminating end thereof.

In addition to comprising a diameter which is slightly greater than the diameter of the closure/stopper itself, the multi-layer film barrier of the present invention is constructed with a thickness ranging between about 0.001 inches and 0.010 inches.

The multi-layer film barrier construction of the present invention is preferably formed with at least two separate and distinct layers, but may be formed with a plurality of layers. At least one layer comprises the bonding material for securely affixing the film to the stopper/closure, while at least a second layer is constructed for controlling and/or limiting the passage of gases, chemicals and compounds through the terminating end of the stopper/closure. In this regard, the composition of the barrier layer of the multi-layer film of the present invention preferably comprises material having a low permeability to oxygen, hydrogen, and carbon dioxide, while also reducing or eliminating the passage of fruity ester compounds contained in the wine, such as ethyl octanoate.

In this way, compounds of this nature are prevented from being transferred from the wine into the stopper/closure, thereby enhancing the taste, bouquet, and a flavor of the wine while also increasing the storage life of the wine in the bottle. Furthermore, by limiting the passage of oxygen into the headspace of the wine, the multi-layer film barrier of the present invention prevents oxygen from being transmitted into the headspace of the wine during the insertion of the stopper/closure, thereby maintaining desired sodium dioxide levels in the wine bottle.

In general, any film material capable of providing these characteristics can be employed as one layer of the multi-layer film barrier of the present invention. Such materials include one or more polymers selected from the group consisting of poly-vinyllidenechloride (PVDC), ethylene vinyl alcohol (EVOH), polyacrylonitrile and copolymers thereof, polyethylene and copolymers thereof, polypropylene and copolymers thereof, polyvinyl chloride and copolymers thereof, and other similar materials.

In forming the multi-layer film barrier of the present invention, an adhesive layer may be affixed to the barrier layer using any desired known process. Typically, the affixation process employed would be one selected from the group consisting of lamination or spray extrusion. Regardless of the method for affixing the adhesive layer to the barrier layer, suitable adhesive layer materials include heat activated adhesive compounds, hot melt adhesive compounds, and other similar compositions. Suitable adhesive compounds include ethylene vinyl acetate, methyl methacrylate based polymers, metalacine based compounds, polyamides, polyurethanes, polyethylenes, and other similar compositions.

Preferably, the multi-layer film member comprises two or more layers, wherein the material for each layer is selected from the group consisting of ethylene vinyl alcohol (EVOH), polyamide, polypropylene, and polyethylene.

One of the problems that has typically been encountered with prior art constructions is the inability of the barrier layer mounted to the end of the synthetic closure/stopper to remain unaffected by the insertion of the stopper/closure in the bottle. Typically, the clamping jaws force the closure/stopper to be compressed up to one third of its normal diameter before being released when inserted in the bottle. Although this process is effective in inserting stopper/closures and wine bottles efficiently, most prior art barrier layer members mounted to the terminating end of the closure/stopper become wrinkled or separate from the end of the stopper/closure.

In accordance with the present invention, the multi-layer film employed as a barrier layer incorporates a uniquely constructed surface treatment formed thereon. In this regard, the surface treatment preferably comprises applying a texture pattern or embossed pattern on the surface of the multi-layer film which is constructed for both aesthetic appeal as well as enabling the multi-layer film to remain substantially unaffected by the insertion process of the stopper/closure in the wine bottle. As a result, the prior art difficulties encountered in this regard are virtually eliminated.

In the preferred process employed for securely affixing the multi-layer film to the terminating end of the closure/stopper, a specially constructed heat stamping application tool is employed. As it clearly depicted in FIG. 6, heat stamping application tool 35 comprises a generally convex, conical, or dome shaped surface 36 which is employed for contacting multi-layer film 16 and 18 and assuring that multi-layer film 16 and 18 are securely bonded to terminating ends 27 and 28 of closure/stopper 20.

In its preferred construction, application tool 35 comprises a heated stamping tool preferably made from metal. In addition, the outer, exposed surface of convex, conical, or dome shaped surface 36 preferably comprises an embossing texture formed thereon. In this way, the surface treatment desired for multi-layered films 16 and 18 is easily achieved by applying the desired textured pattern or embossing pattern directly onto the surface of multi-layered film 16 and 18 as application tool 35 contacts multi-layered films 16 and 18.

In addition, as mentioned above, in the preferred embodiment, surface 36 of application tool 35 is constructed with a dome, convex, or conical shape. In this way, as heat stamping application tool 35 is advanced into contact with multi-layer films 16 and 18, the lamination or heat bonding process begins at the center of multi-layered films 16 and 18 and continues radially outwardly therefrom. As a result, the heat bonding or lamination process is achieved which begins at the center of multi-layer films 16 and 18, and advances therefrom an all radial directions simultaneously, providing a smooth, application process which securely bonds each multi-layer film 16 and 18 to the opposed terminating ends of closure/stopper 20 free of any entrapped air.

By employing application tool 35 with dome, convex, or conical shaped surface 36, assurances are provided that no air is trapped between multi-layer films 16 and 18 and the terminating ends of closure/stopper to which the multi-layer films are affixed. As a result, no possibility exists that an air bubble or retained air pocket can be formed between multi-layer films 16 and 18 and closure/stopper 20. In order to achieve this desired result, the center of the dome, convex, or conical shaped surface 36 is preferably constructed with the center thereon being raised a distance ranging between about 0.1 mm and 5 mm. In this way, all of the attributes desired for a securely contacted and fully engaged multi-layer film with closure/stopper are realized.

The invention accordingly comprises an article of manufacture possessing the features, properties, and relation of elements which will be exemplified in the article hereinafter described, and the scope of the invention will be indicated in the claims.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim is new and desire to secure by Letters Patent is:

1. A closure/stopper for a product retaining container constructed for being inserted and securely retained in a portal forming neck of the container for sealingly closing the container and retaining a product therein, said closure/stopper comprising:

A. an elongated, cylindrically shaped core member having an outer curved surface and substantially flat terminating ends; and B. a multi-layer film member a) affixed to at least one substantially flat terminating end of said substantially flat terminating ends in complete, intimate, bonded engagement with substantially an entire substantially flat surface thereof, and b) comprising an extending portion extending beyond a terminating edge of said at least one substantially flat terminating end, with said extending portion peripherally surrounding and engaging a portion of the outer curved surface, and c) constructed for controlling passage of gases, chemicals, and compounds through the closure/stopper for optimizing desired characteristics of the product;

wherein the multi-layer film member is affixed to the at least one substantially flat terminating end at a first heat bonded zone, the extending portion of the multi-layer film member is affixed to the outer curved surface at a second heat bonded zone, and the multi-layer film member affixed to the at least one substantially flat terminating end comprises an embossed pattern formed on a surface thereof, conferring a non-uniform thickness to the multi-layer film member; and wherein the multi-layer film member of the closure/stopper is configured to completely seal a desired product in an interior volume of the container when the closure/stopper is inserted in the portal forming neck of the container.

2. The closure/stopper defined in claim 1, wherein the extending portion of the multi-layer film member is further defined as comprising a width ranging between about 0.25 mm and 5 mm.

3. The closure/stopper defined in claim 2, wherein the extending portion of the multi-layer film member is defined as comprising a width ranging between about 0.75 mm and 2.5 mm.

4. The closure/stopper defined in claim 3, wherein the extending portion of the multi-layer film member is defined as comprising a width ranging between about 1 mm and 1.5 mm.

5. The closure/stopper defined in claim 1, wherein said multi-layer film member comprises at least two separate and distinct layers, with a first layer of said at least two layers comprising bonding material and a second layer of said at least two layers comprising barrier material for controlling and/or limiting the passage of gases, chemicals and compounds through a terminating end of the substantially flat terminating ends of the closure/stopper.

6. The closure/stopper defined in claim 5, wherein the second layer of said at least two layers is further defined as comprising a low permeability to oxygen, hydrogen, and carbon dioxide and the ability to reduce or eliminate passage of fruity ester compounds including ethyl octanoate.

7. The closure/stopper defined in claim 5, wherein the second layer of said at least two layers is further defined as being selected from the group consisting of polyvinylidene chloride (PVDC), ethylene vinyl alcohol (EVOH), polyacrylonitrile and copolymers thereof, polyethylene and copolymers thereof, polypropylene and copolymers thereof, and polyvinyl chloride and copolymers thereof.

8. The closure/stopper defined in claim 7, wherein the first layer of said at least two layers is further defined as comprising at least one adhesive compound selected from the group consisting of ethylene vinyl acetate, methyl methacrylate based polymers, metallocene based compounds, polyamides, polyurethanes, and polyethylenes.

9. The closure/stopper defined in claim 1, wherein said embossed pattern enables the multi-layer film member to remain unaffected by compression during insertion of the closure/stopper into the container.

10. The closure/stopper defined in claim 1, wherein the multi-layer film member is further defined as comprising a thickness ranging between about 1 micron and 2,000 microns.

11. The closure/stopper defined in claim 1, wherein the multi-layer film member is further defined as comprising a thickness ranging between about 5 microns and 150 microns.

12. The closure/stopper defined in claim 1, wherein the multi-layer film member is further defined as comprising a thickness ranging between about 10 microns and 100 microns.

13. The closure/stopper defined in claim 1, wherein the closure/stopper has an oxygen transfer rate (OTR) in an axial direction as determined by ASTM D-3985-81 of less than about 0.010 cc/day.

14. The closure/stopper defined in claim 13, wherein the closure/stopper has an oxygen transfer rate (OTR) of less than about 0.005 cc/day.

15. The closure/stopper defined in claim 14, wherein the core member is further defined as comprising medium density or low density, closed cell, foamed plastic comprising one or more materials selected from the group consisting of inert polymers, homopolymers, and copolymers.

16. The closure/stopper defined in claim 15, wherein said closed cell, foamed plastic is further defined as comprising at least one material selected from the group consisting of polyethylenes, metallocene catalyst polyethylenes, polybutanes, polybutylenes, polyurethanes, silicones, vinyl-based resins, thermoplastic elastomers, polyesters, ethylenic acrylic copolymers, ethylene-vinyl-acetate copolymers, ethylene-methyl-acrylate copolymers, ethylene-butyl-acrylate copolymers, ethylene-propylene-rubber, styrene butadiene rubber, ethylene-ethyl-acrylic copolymers, ionomers, polypropylenes, and copolymers of polypropylene and copolymerizable ethylenically unsaturated comonomers, as well as ethylenic acrylic copolymers, ethylene-vinyl-acetate copolymers, ethylene-methyl-acrylate copolymers, thermoplastic polyurethanes, thermoplastic olefins, thermoplastic vulcanizates, flexible polyolefins, fluorelastomers, fluoropolymers, teflons, and blends thereof, ethylene-butyl-acrylate copolymers, ethylene-propylene-rubber, styrene butadiene rubber, and ethylene-ethyl-acrylic copolymers.

17. The closure/stopper defined in claim 16, wherein said closed cell, foamed plastic material is further defined as comprising one or more polyethylenes selected from the group consisting of high density, medium density, low density, linear low density, ultra high density, and medium low density polyethylene.

18. The closure/stopper defined in claim 1, wherein the entire substantially flat surface of the at least one substantially flat terminating end of the core member is free of any entrapped air.

19. A method of forming a closure/stopper according to claim 1, said method comprising:

A. disposing the multi-layer film member over said at least one substantially flat terminating end of said core member; and B. applying a heated heat stamping application tool to the multi-layer film member to cause the multi-layer film member to be affixed to said at least one substantially flat terminating end in complete, intimate, bonded engagement with substantially the entire substantially flat surface thereof.

20. The method of claim 19, wherein the heated heat stamping application tool comprises an application surface having at least one of a convex, conical, or dome-shaped surface, wherein applying the heated heat stamping application tool to the multi-layer film member causes the application surface of the heated heat stamping application tool to be advanced into contact with the multi-layer film member beginning at a center of the multi-layer film member and continuing radially outwardly therefrom, thereby causing the multi-layer film member to be affixed to the at least one substantially flat terminating end in complete, intimate, bonded engagement with substantially the entire substantially flat surface thereof, such that the entire substantially flat surface is free of any entrapped air.

21. The method of claim 20, wherein the application surface of the heated heat stamping application tool comprises an embossing texture formed thereon, such that applying the heated heat stamping application tool to the multi-layer film member causes the application surface to form said embossed pattern on the multi-layer film member.

* * * * *